US006817146B2

(12) United States Patent
Jasperson

(10) Patent No.: US 6,817,146 B2
(45) Date of Patent: Nov. 16, 2004

(54) DOOR LITE UTILIZING SLUMP GLASS AND METHOD FOR FORMING THE SAME

(75) Inventor: Stephen J. Jasperson, Fort Wayne, IN (US)

(73) Assignee: TT Technologies, Inc., Maumee, OH (US)

( * ) Notice: Subject to any disclaimer, the term of this patent is extended or adjusted under 35 U.S.C. 154(b) by 12 days.

(21) Appl. No.: 10/280,336

(22) Filed: Oct. 25, 2002

(65) Prior Publication Data

US 2004/0074147 A1 Apr. 22, 2004

Related U.S. Application Data

(60) Provisional application No. 60/344,494, filed on Oct. 26, 2001.

(51) Int. Cl.[7] ..... E06B 3/66

(52) U.S. Cl. ..... 52/204.59; 52/204.59; 52/204.61; 52/311.1; 52/456; 52/656.8

(58) Field of Search ..... 52/204.59, 204.593, 52/204.61, 204.62, 204.71, 311.1, 311.2, 456, 656.8, 666, 668

(56) References Cited

U.S. PATENT DOCUMENTS

| | | | | | |
|---|---|---|---|---|---|
| 3,226,903 | A | * | 1/1966 | Lillethun | 52/172 |
| 3,512,320 | A | * | 5/1970 | Choquette et al. | 52/172 |
| 3,889,434 | A | * | 6/1975 | Shelver | 52/172 |
| 5,022,206 | A | * | 6/1991 | Schield et al. | 52/455 |
| 5,477,647 | A | * | 12/1995 | Yates, Jr. | 52/204.57 |
| 5,765,325 | A | * | 6/1998 | DeBlock | 52/204.5 |
| 5,834,124 | A | * | 11/1998 | Pease et al. | 428/430 |
| 5,884,441 | A | * | 3/1999 | Monroe et al. | 52/204.59 |
| 6,138,433 | A | * | 10/2000 | Ridge | 52/786.11 |
| 6,598,282 | B2 | * | 7/2003 | Robles Gil-Bueno | 29/455.1 |
| 6,640,510 | B2 | * | 11/2003 | Kane | 52/204.59 |

* cited by examiner

*Primary Examiner*—Brian E. Glessner
(74) *Attorney, Agent, or Firm*—Brooks Cushman P.C.

(57) ABSTRACT

One aspect of the present invention relates to a lite for a building structure. The lite includes a first peripheral caming framework and a first glass unit supported within the first peripheral caming framework. The first glass unit includes a plurality of glass members and a second caming framework supporting the glass members. The glass members include at least one slump glass member.

23 Claims, 3 Drawing Sheets

DOOR LITE UTILIZING SLUMP GLASS AND METHOD FOR FORMING THE SAME

CROSS-REFERENCE TO RELATED APPLICATIONS

This application claims the benefit of U.S. provisional application Ser. No. 60/344,494, filed Oct. 26, 2001.

BACKGROUND OF THE INVENTION

1. Field of the Invention

The present invention relates to lite assemblies utilizing slump glass and to methods for forming the same.

2. Background Art

Recently, the interior and exterior design of buildings structures have incorporated increasing quantities of decorative glass units, called lites or lite assemblies, having one or more aesthetic glass panels. Lite assemblies may be a single panel of glass, i.e., an aesthetic panel; double-pane units where an aesthetic panel is typically separated from a second sheet of glass separated by a spacer; or triple-pane units where an aesthetic panel is typically situated between two other pieces of glass and separated by a spacer. The aesthetic panel typically comprises various glass members arranged in a decorative manner. The glass members of an aesthetic panel are typically supported within support members called "caming". Lite assemblies are commonly used in various types of door assemblies such as storm doors, patio doors, and entry doors. The most common use of lites in these types of door assemblies are as door lites, side lite lites, borrowed lites, and transoms. Lites are also commonly used in decorative wall windows, mirrors, and other architectural applications.

Slump glass is a decorative glass member made by heating a glass member to its slumping temperature, allowing the glass member to take the form of decorative surface texture of a mold into which the glass member is allowed to slump, and then allowing the glass member to cool. Though being quite decorative, manufacturing constraints have prevented slump glass from being used in lite assemblies having camed aesthetic panels. While these manufacturing constraints pose problems from all, types of lites, these constraints are particularly problematic for multi-pane lite assemblies. This is because slump glass has traditionally been made with glass that is somewhat thicker than non-slump glass. As a consequence, when an attempt has been made to construct a multi-pane lite assembly using an aesthetic glass panel with one or more slump glass members, the aesthetic panel tends to strike the glass panels that make up the exterior and interior sheets of glass of the assembly when opening and closing a door. When the aesthetic panel containing a slump glass member strikes, the exterior and interior glass sheets, several negative visual and structural effects occur including the following: darkened solder, cracked solder joints, and scratched or otherwise damaged exterior or interior glass sheets. Discerning customers prefer not to have such flaws in lites.

What is needed is a lite for a building structure which utilizes a glass panel with at least one slump glass member wherein the construction of the lite overcomes at least one constraint in the prior art.

SUMMARY OF THE INVENTION

In at least one aspect of the present invention, a lite assembly for a building structure is provided. The lite includes a first peripheral caming framework and a first glass unit that is within the first peripheral caming framework. The first glass unit comprises a plurality of glass members and a second caming framework that supports the glass members. At least one of the glass members includes a slump glass member. The slump glass member has a portion having a thickness sufficient to allow it to be received within portions of the second caming framework.

In certain embodiments, the slump glass member has a perimeter section that has a first thickness and a body section that has a second thickness. The second thickness of the slump glass member is greater than the first thickness of the slump glass member.

In certain embodiments, the lite for a building structure may also include a second glass unit spaced from the first glass unit. The lite may also include a third glass unit where the first glass unit is disposed between the second and third glass units. The lite may include a border spacer disposed between the second and third glass units. This border spacer may have a slot in which the first glass unit is supported. Also, the second caming framework may comprise a plurality of intersecting caming members where at least a substantial portion of the caming members intersect another caming member at a substantially 90 degree angle. In addition, the perimeter section of each glass member may comprise four corner sections such that each glass member is supported within the caming members that intersect at substantially 90 degree angles.

Another aspect of the present invention further relates to a lite for a building structure which includes a first peripheral caming framework. It also comprises a first glass unit within the first peripheral caming framework. The first glass unit includes a plurality of glass members and a second caming framework that supports the glass members. The glass members comprise a plurality of slump glass members. Each of the slump glass members has a perimeter section which has a first thickness of about 2–4 millimeters, and more preferably of about 2.5–3.5 millimeters, and a body section which has a second thickness which is preferably about 6–9 millimeters in thickness, and more preferably about 7.95 millimeters in thickness.

Another aspect of the present invention further relates to a lite for a building structure. The lite comprises a first peripheral caming framework, and a first glass unit supported within the first peripheral caming framework. The first glass unit comprises a plurality of glass members and a second caming framework supporting the glass members. The glass members comprises at least one slump glass member. The second caming framework comprising a plurality of intersecting caming members, with at least a substantial portion of the caming members intersecting at least another caming member at a substantially 90 degree angle.

In other embodiments, the lite for a building structure includes a second glass unit spaced from the first glass unit. The second glass unit may have a thickness of about 2.75–4 millimeters. It may also include a third glass unit, with the first glass unit being disposed between the second and third glass units. The third glass unit may also have a thickness of about 2.75–4 millimeters. The lite may include a border spacer disposed between the second and third glass units. The border spacer has a slot in which the first glass unit is supported. The lite may include the second caming framework where this framework comprises a plurality of caming members. Each caming member has a slot having a third thickness. The third thickness is sufficiently thicker than the first thickness of the slump glass member perimeter such that the perimeter section is supported within the slots of the caming member. Also, the first caming framework comprises a plurality of intersecting caming member, with at least a substantial portion of the caming members intersecting other caming members at substantially 90 degree angles. Finally, the perimeter section of each glass member may comprise four corner sections, such that the glass members are supported within caming members that intersect at substantially 90 degree angles.

The present invention is also directed to a method for forming a lite for a building structure. The method includes providing a first peripheral caming framework. It also includes providing a first glass unit comprising a plurality of glass members supported within a second caming framework. The glass members include at least one slump glass member. This slump glass member has a perimeter section with a first thickness and a body section with a second thickness which is greater than the thickness of the perimeter section. The method includes supporting the first glass unit within the first peripheral caming framework.

The method may also include the step of providing a second glass unit spaced from the first glass unit. The method may also include the step of providing a third glass unit, with the first glass unit being disposed between the second and third glass units. Additionally, a border spacer may be provided between the second and third glass units. The border spacer may have a slot in which the first glass unit is supported.

BRIEF DESCRIPTION OF THE DRAWINGS

FIG. 4 is an enlarged view of a portion of a component of the door assembly of FIG. 1; and.

DETAILED DESCRIPTION OF THE PREFERRED EMBODIMENT(S)

As required, detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
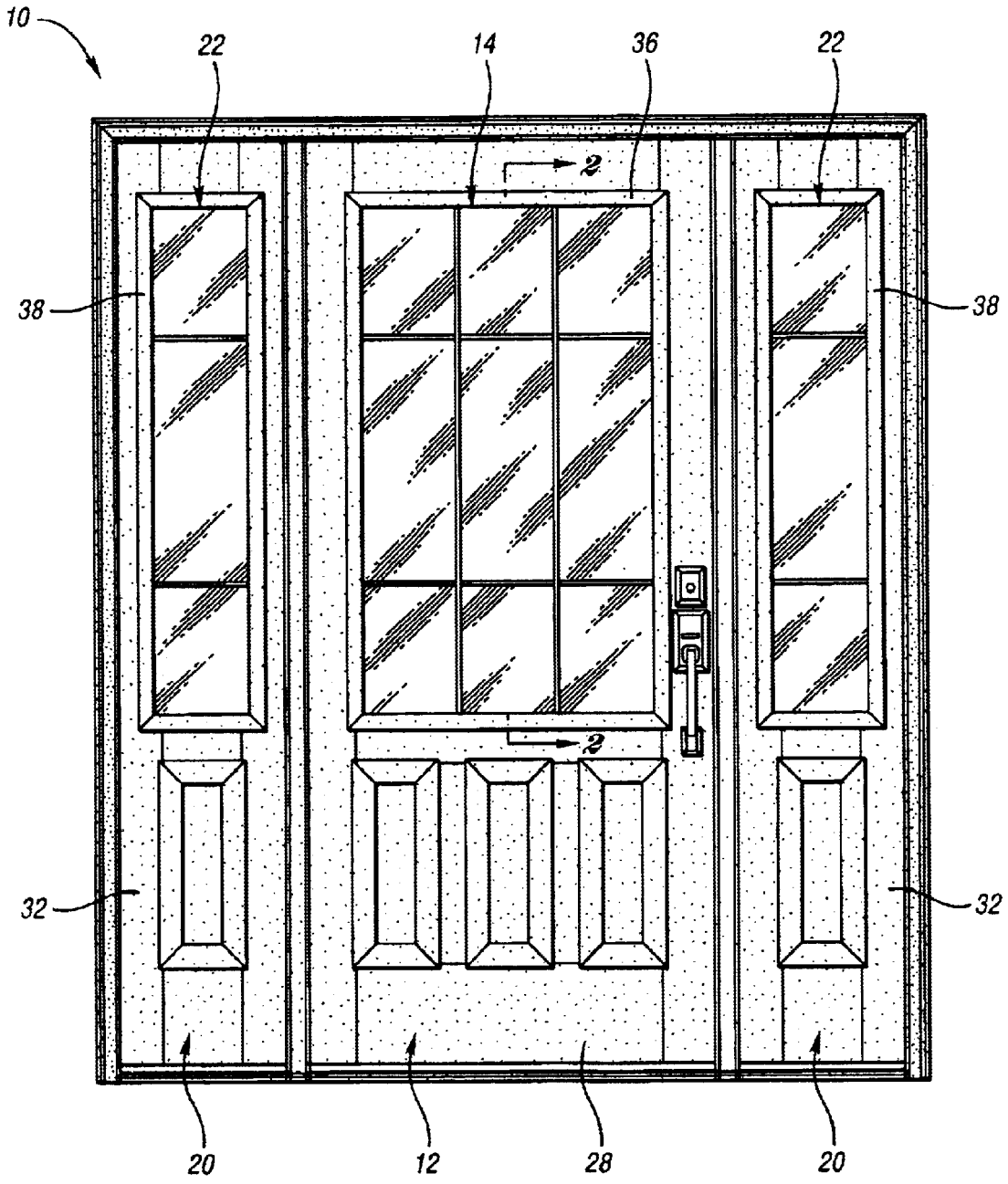
FIG. 1 is a front plan view of a door assembly which incorporates door lites made in accordance with the present invention.

With reference to FIG. 1, an exemplary illustration of an embodiment of the present invention is shown. A door assembly 10 comprising an exterior door panel 12 having a door lite 14 and exterior side lite panels 20 having side lites 22 is shown in FIG. 1. Door panel 12 comprises a main body portion 28, which is typically made of metal, wood, or compression molded plastic material in accordance with construction techniques well known to those skilled in the art. The side lite panels 20 comprise a main body portion 32, which is typically made of the same material as the main body portion 28 of the door panel 12. The door lite 14 and the side lites 22 are supported within the door panel 12 and side lite panels 20, respectively, by conventional frame assemblies 36 and 38, respectively. The door lite 14 and side lites 22 are shown to have a rectangular shape. However, in certain embodiments, the lites may be of any desired shape, size, and configuration, including circular or oval shapes, depending upon the door assembly design as dictated by the wishes of the owner and the architectural features of the remaining portions of the building structures.

Figure 2:
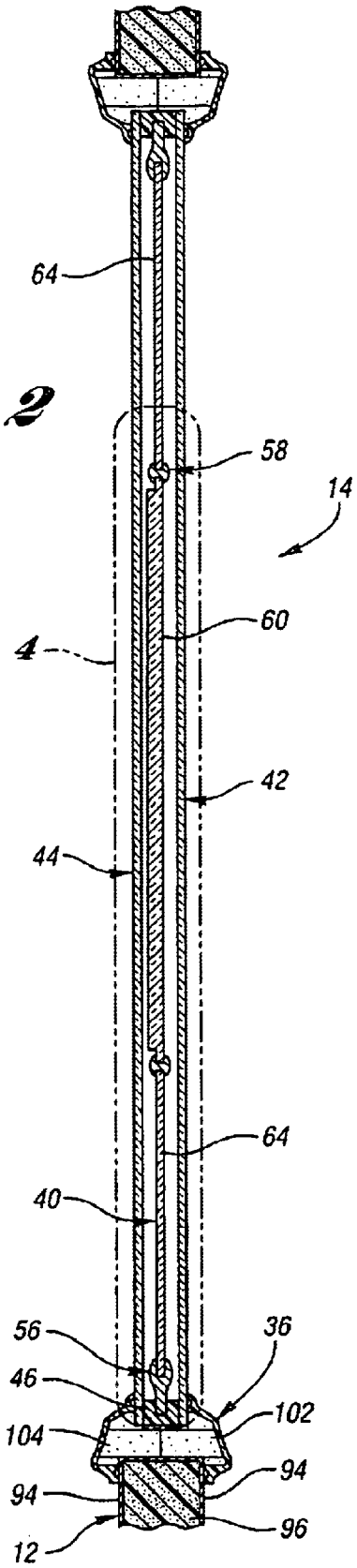
FIG. 2 is a cross sectional view of a component of the door assembly taken along the line 2—2 of FIG. 1.

Making reference to FIG. 2, an embodiment of a triple-paned door lite is shown. While a triple-paned door lite is shown, it should be appreciated that other types of lites, such as a single- and double-paned door lites, can also be made in accordance with, and are thus covered by, the present invention. While certain embodiments of the present invention are described in the context of door and side lites 14 and 22, it will be appreciated that lites in accordance with the present invention may be incorporated into wall windows, door windows, transoms, various other building articles, and the like, as well. It should also be understood that lites made in accordance with, and covered by, the present invention may be formed in designs other than those set forth herein.

The lite 14 shown in FIG. 2 comprises an aesthetic glass panel 40, an interior glass panel 42, an exterior glass panel 44, and a spacer 46. The lite 14 typically has a thickness of about 0.75–2.0 inches (19–51 mm), and more preferably of about 1–1.25 inches (25.4–32 mm). The interior and exterior glass panels 42 and 44 typically have a thickness of about 0.1–0.16 inches (2.75–4 mm), and more preferably about 0.12–0.13 inches (3–3.2 mm). The glass panels 42 and 44 can be any suitable type of glass, such as laminated glass, glass with film, pyrolytic glass, and is preferably tempered glass. The aesthetic panel 40 typically has a thickness between about 2–9 mm and length and width dimensions that each range between about 150–2,035 mm.

The spacer 46 is generally rectangular in shape and contains a slot 50 (FIG. 4) therein. The aesthetic panel 40 is substantially supported within the slot 50. The spacer 46 is made of any suitable material, and is preferably made of an insulating material. While any suitable insulating material may be used, polysulfides, silicones, polyurethanes, and polyisobutyls have been found to be particularly effective. A suitable spacer is the SWIGGLE STRIP®, from TruSeal Technologies of Beachwood, Ohio. The spacer 46 is preferably about 0.5–1.0 inches (13–26 mm) thick, and is most preferably about 0.75 inches (19 mm) thick. The interior and exterior glass panels 42 and 44 are adhesively disposed on opposite sides of the spacer 46.

Figure 3:
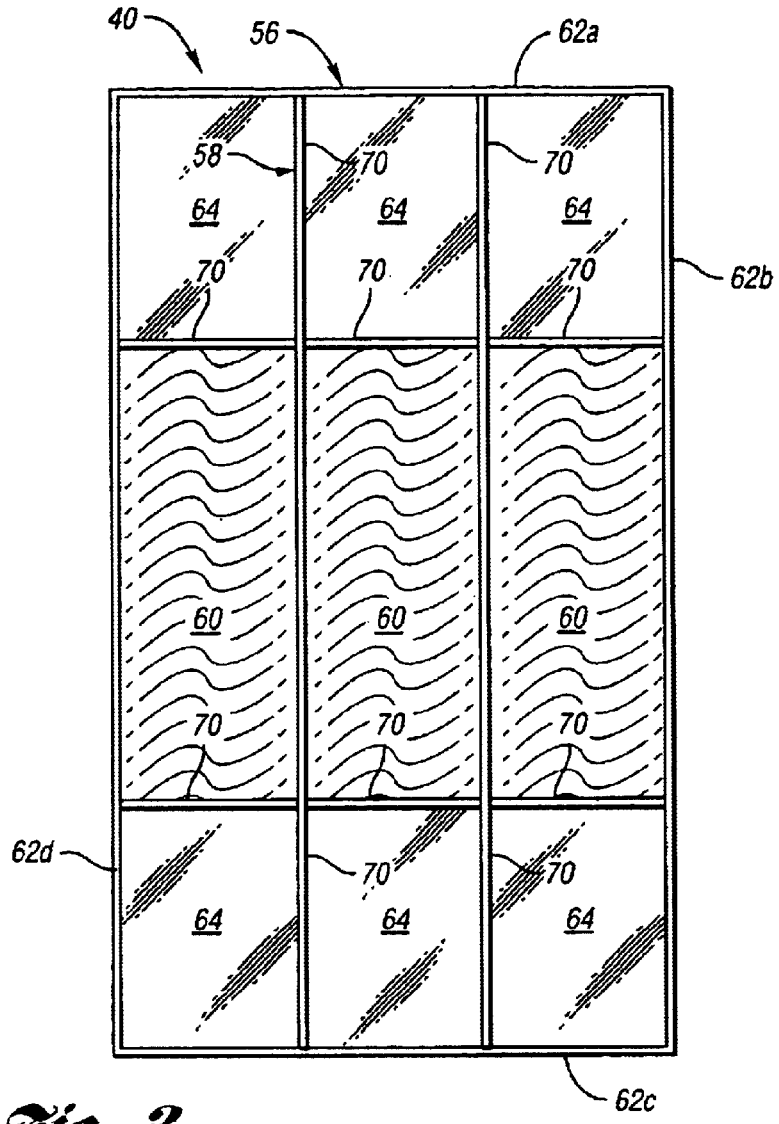
FIG. 3 is a front plan view of a component of the door assembly.

As shown in FIG. 2, and in more detail in FIG. 3, the aesthetic panel 40 comprises a peripheral caming framework 56, an interior support caming framework 58, a plurality of slump glass members 60, and a plurality of non-slump glass members 64. Turning to FIG. 3, an enlarged view of the aesthetic panel 40 is shown therein. The peripheral caming framework 56 preferably comprises four exterior caming members 62*a*–62*d* connected by solder (not shown). In the illustrated embodiment, the peripheral framework 56 comprises a rectangular shape with the caming members 62*a*–62*d* joined to form corner sections having substantially 90° angles. The exterior caming members 62*a*–62*d* of the peripheral caming framework 56 have generally Y-shaped profiles (FIG. 4) with a single channel 90 facing and supporting the glass members 60 and 64.

The peripheral framework caming 56 (FIG. 3) supports the interior caming framework 58, the slump glass members 60, and the non-slump glass members 64. The non-slump glass members 64 and the slump glass members 60 are interconnected by, and supported within, the interior support caming framework 58. The perimeter section of a substantial proportion of the glass member 60 and 64, and in the embodiments shown in the Figures, all of the glass members preferably, comprise four corner sections. These corner sections are preferably at substantially 90 degree angles.

The interior caming support framework 58 comprises a plurality of interconnected individual members 70 that support and interconnect glass members 60 and 64. Solder material (not shown) is provided at the intersection of the respective interior caming members 70. Preferably a substantial, and as in the embodiment shown in FIG. 3, most preferably, all of the interior caming members 70 intersect other caming members at substantially 90 degree angles. It is believed this provides stability to the aesthetic panel 40 to help prevent black marks from forming on the interior and exterior glass panels 42 and 44. It should be noted that the arrangement of the caming 56 and 58 and the glass members 60 and 64 are not necessarily intended to be limited to the arrangement shown in the Figures but may be arranged in other forms as desired. The interior caming members 70 have substantially H-shaped profiles, with oppositely facing channels 88, for receiving and supporting the glass members 60 and 64. At least a majority of the members that comprise the caming frameworks 56 and 58 may be formed of metal, plastic, or other suitable material depending on the intended application.

Figure 4:
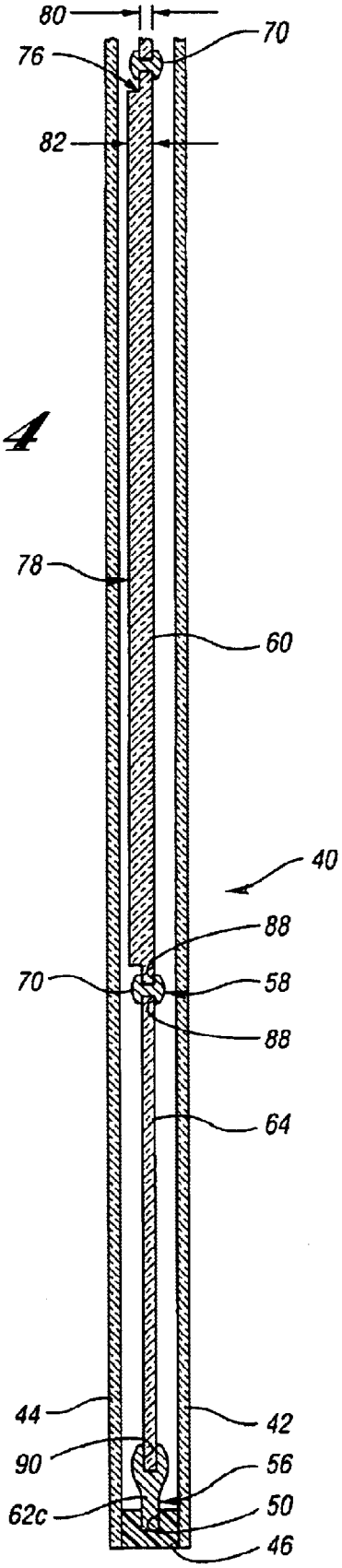
Figure 5:
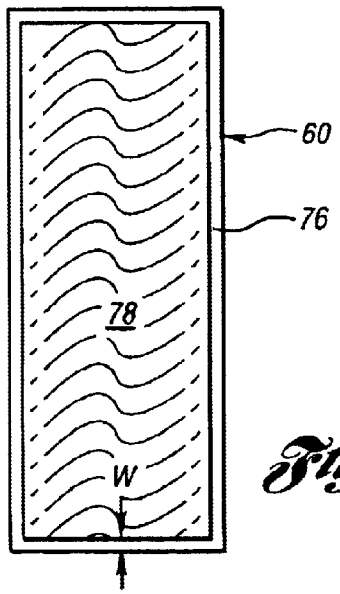
FIG. 5 is a front plan view of a component of the door assembly.

Turning to FIG. 4, portions of components shown in FIG. 2 is shown enlarged. The majority of the slump glass members 60 typically have a general thickness greater than the thickness of the interior and exterior glass panels 42 and 44 and the channels 88 and 90 of the caming members 70 and 62*a*–62*d*, respectively. More specifically, referring to FIGS. 4 and 5, each of the slump glass members 60 have a perimeter section 76 having a first thickness 80 and a main body portion 78 having a second thickness 82. The slump glass members 60 typically have a perimeter thickness 80 that is slightly less than the thickness of the channels 88 and 90 for the caming members 70 and 62*a*–62*d*, respectively, such that at least some of the perimeter section 76 of the slump glass members 60 can fit, and be received, within the channels 88 and 90 of the caming members. The channels typically have thicknesses of about 2.2–4.2 mm, more preferably about 2.7–3.5 mm, and most preferably about 3.2 mm.

It has been found that in certain embodiments, certain parameters of first thickness 80 and second thickness 82 maximize the stability of the aesthetic panel 40. The following table sets forth exemplary dimensions for first thickness 80 and second thickness 82 for slump glass members 60:

| Dimension | 80 | 82 |
|---|---|---|
| Preferred Value | 3.0 mm (+/−1 mm) | 6–9 mm |
| Most Preferred Value | 3.0 mm (+/−0.5 mm) | 7.95 mm |

While not always the case, the width W of the perimeter sections 76 of the slump glass members 60 is generally about, and more preferably slightly greater than, the depth of the channels 88 and 90 of the caming members 70 and 62*a*–62*d*. The depth of the channels 88 and 90 of the caming members 70 and 62*a*–62*d* are typically about 1–5 mm, more preferably about 1.5–3 mm, and most preferably about 2 mm. As such, the width W of the perimeter sections 76 of the slump glass members 60 is generally about 1.05–20 mm, more preferably about 1.55–10, and most preferably about 2.05 mm.

It should be noted that conventional means can be used to obtain the exemplary dimensions of the slump glass members 60. These means may include mechanical grinding mechanisms or other technique utilized in the slump glass member manufacturing process such as utilization of a secondary mold around the perimeter of the glass member. Suitable slump glass members 60 can be obtained from Trimlite of Seattle, Wash.

Methods for forming lites in accordance with the present invention will be readily apparent to those of ordinary skill in the art upon a reading of the foregoing description. Generally speaking, the aesthetic panel 40 can be made by forming the peripheral caming framework 56 about the interior caming framework 58, the slump glass members 60, and the non-slump glass members 64. This is generally done by placing the glass members 60 and 64 within the interior caming framework members 70 in a desired arrangement and then soldering the interior caming framework members 70 to each other and to the peripheral caming framework members 62*a*–62*d*. The aesthetic panel 40 is then disposed within the slot 50 in the spacer 46. The interior and exterior glass panels 42 and 44, respectively, are then adhesively secured to opposing ends of the spacer 46. This can be done by clamping the glass panels 42 and 44 to the interior and exterior surfaces of the spacer. To provide adhesion between the spacer 46 and the glass panels 42 and 44, the material of the spacer can be an adhesive material or alternatively, an adhesive material may be provided between the spacer and the glass panels.

Referring to FIG. 2, once the lite 14 has been made, it is then supported within an opening in a panel, such as the door panel 12 shown in FIG. 2, by a frame member 36. As discussed above, the panel 12 can be made of any suitable material, and as shown in FIG. 2 is a compression molded member comprising compression molded door skins 94 and a foam member 96 disposed therebetween. The frame member 36 comprises an interior frame member 102 and an exterior frame member 104. The interior and exterior frame members 102 and 104 are secured together by connecting members, such as fasteners. The lite 14 is preferably adhesively secured first to the exterior frame member 104 which is then supported within the opening of the door panel 12. The interior and exterior frame members 102 and 104 can then be fastened together and to the main body portion 28 of the door panel 12.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A lite for a building structure, the lite comprising:

a first peripheral caming framework; and a first glass unit within the first peripheral caming framework, the first glass unit comprising a plurality of glass members and a second caming framework interconnecting the glass members, the second caming framework comprising channels of substantially uniform thickness, the glass members being supported within channels of the second caming framework, the glass members comprising at least one slump glass member, the slump glass member having a portion having a thickness sufficient to allow the slump glass member to be received within portions of the second caming framework.

2. The lite for a building structure of claim 1 wherein the slump glass member has a perimeter section having a first thickness and a body section having a second thickness which is greater than the first thickness.

3. The lite for a building structure of claim 2 further comprising a second glass unit spaced from the first glass unit.

4. The lite for a building structure of claim 3 further comprising a third glass unit, the first glass unit being disposed between the second and third glass units.

5. The lite for a building structure of claim 4 wherein a border spacer is disposed between the second and third glass units, the border spacer having a slot in which the first glass unit is supported.

6. The lite for a building structure of claim 5 wherein the second caming framework comprises a plurality of intersecting caming members, at least a substantial portion of the caming members intersecting at least another earning member at a substantially 90 degree angle.

7. The lite for a building structure of claim 6 wherein the perimeter section of each glass member comprises four corner sections, such that the glass members are supported within caming members that intersect at substantially 90 degree angles.

8. The lite for a building structure of claim 6 wherein the first peripheral earning framework is rectangular in shape.

9. A door assembly comprising:

a panel having an opening; and the lite of claim 1 supported within the opening.

10. A door assembly comprising:

a panel having an opening; and a decorative unit supported within the opening of the panel, the decorative unit comprising the lite of claim 5.

11. The lite of claim 1 wherein the glass members further comprise at least one non-slump glass member.

12. A lite for a building structure, the lite comprising:

a first peripheral caming framework; and a first glass unit supported within the first peripheral caming framework, the first glass unit comprising a plurality of glass members and a second earning framework supporting the glass members, the glass members comprising at least one slump glass member, the second caming framework comprising a plurality of intersecting earning member, at least a substantial portion of the caming members intersecting at least another caming member at a substantially 90 degree angle.

13. The lite for a building structure of claim 12 further comprising a second glass unit spaced from the first glass unit, the second glass unit being tempered and having a thickness of about 2.75–4 mm.

14. The lite for a building structure of claim 13 further comprising a third glass unit, the first glass unit being disposed between the second and third glass units, the third glass unit having a thickness of about 2.75–4 millimeters.

15. The lite for a building structure of claim 14 further comprising a border spacer, the border spacer being disposed between the second and third glass units, the border spacer having a slot in which the first glass unit is supported.

16. The lite for a building structure of claim 15 wherein the perimeter section of each glass member comprises four corner sections, such that each glass member is supported within caming members that intersect at substantially 90 degree angles.

17. A method for forming a lite for a building structure, the method comprising the steps of:

a) providing a first peripheral caming framework;

b) providing a first glass unit comprising a plurality of glass members supported within channels of substantially uniform thickness within a second caming framework, the glass members comprising at least one slump glass member, the slump glass member having a perimeter section having a first thickness and a body section having a second thickness which is greater than the first thickness; and c) supporting the first glass unit within the first peripheral caming framework.

18. The method of claim 17 including the step of providing a second glass unit spaced from the first glass unit.

19. The method of claim 18 including the step of providing a third glass unit, the first glass unit being disposed between the second and third glass units.

20. The method of claim 19 including the step of providing a border spacer between the second and third glass units, the border spacer having a slot in which the first glass unit is supported, the slot having a third thickness sufficiently wider than the width of the first peripheral caming framework.

21. The method of claim 20 wherein the step of providing the first glass unit comprises providing a plurality of caming members intersecting at substantially 90 degree angles and supporting the glass members within the caming members.

22. The method of claim 21 wherein the perimeter section of each glass member comprises four corner sections, such that each glass member is supported within caming members that intersect at substantially 90 degree angles.

23. A lite for a building structure, the lite comprising:

a first peripheral caming framework; and a first glass unit within the first peripheral caming framework, the first glass unit comprising a plurality of glass members and a second caming framework supporting the glass members, the glass members comprising a plurality of slump glass members, each of the slump glass members having a perimeter section having a first thickness of about 2–4 millimeters and a body section having a second thickness of about 6–9 millimeters.

* * * * *

UNITED STATES PATENT AND TRADEMARK OFFICE

CERTIFICATE OF CORRECTION

PATENT NO. : 6,817,146 B2
DATED : November 16, 2004
INVENTOR(S) : Stephen J. Jasperson It is certified that error appears in the above-identified patent and that said Letters Patent is hereby corrected as shown below:

Column 7,
Lines 25, 33 and 53, delete “earning” and insert therefor -- caming --.

Signed and Sealed this

Twenty-second Day of February, 2005

JON W. DUDAS
*Director of the United States Patent and Trademark Office*